US007748234B2

(12) United States Patent
Rhein

(10) Patent No.: US 7,748,234 B2
(45) Date of Patent: Jul. 6, 2010

(54) AIR ENHANCEMENT SYSTEM AND METHODS FOR FOOD PROCESSING SYSTEMS

(75) Inventor: Frank P. Rhein, Delano, TN (US)

(73) Assignee: MP Equipment, Suwannee, GA (US)

( * ) Notice: Subject to any disclaimer, the term of this patent is extended or adjusted under 35 U.S.C. 154(b) by 1222 days.

(21) Appl. No.: 11/006,514

(22) Filed: Dec. 7, 2004

(65) Prior Publication Data

US 2005/0138953 A1 Jun. 30, 2005

Related U.S. Application Data

(60) Provisional application No. 60/527,910, filed on Dec. 8, 2003.

(51) Int. Cl.
*F25D 17/04* (2006.01)

(52) U.S. Cl. ..... 62/408; 62/412

(58) Field of Classification Search ..... 62/408, 62/378, 186, 376, 407, 412; 126/235 R; 454/61, 27

See application file for complete search history.

(56) References Cited

U.S. PATENT DOCUMENTS 432,544 A * 7/1890 Moore ..... 454/42
3,857,252 A 12/1974 Wight
4,103,507 A 8/1978 Benois
4,103,768 A * 8/1978 Persson ..... 198/778
4,156,706 A * 5/1979 Bell et al. ..... 261/109
4,893,708 A 1/1990 Machacek
5,467,612 A 11/1995 Venetucci
5,569,415 A * 10/1996 Phelps ..... 261/23.1
6,412,191 B1 * 7/2002 Moyls ..... 34/328
2003/0207662 A1 * 11/2003 Liu ..... 454/61

OTHER PUBLICATIONS

Air Jet, Air Impingement Oven, FOODesign Machinery & Systems, Inc. Brochure, 4 pages.
FOODesign Machinery & Systems, Inc., Cryo-Jet Ambient and Chilled Air Coolers, 1 page.
Air Jet, Air Impingement Oven, FOODesign Machinery & Systems, Inc. Brochure, 4 pages, Jun. 1998.
FOODesign Machinery & Systems, Inc., Cryo-Jet Ambient and Chilled Air Coolers, 1 page, Jun. 1998.

* cited by examiner

*Primary Examiner*—Melvin Jones
(74) *Attorney, Agent, or Firm*—Hahn Loeser + Parks LLP; Scott M. Oldham, Esq.

(57) ABSTRACT

A system and method are disclosed for enhancing airflow through a vertically oriented spiral freezer or oven stack used for freezing or heating food product. At least one high-static fan assembly is mounted above a spiral stack assembly of the system to accelerate and direct air vertically through the spiral stack assembly. Air is directed through a heat exchanger via at least one circulation fan, cooling or heating the air via the heat exchanger. The cooled or heated air is vertically accelerated through the vertically oriented spiral stack assembly via at least one high-static fan assembly mounted above the spiral stack assembly. A method is also disclosed to retrofit a system having a vertically oriented spiral freezer or oven stack to enhance airflow through the stack.

26 Claims, 8 Drawing Sheets

AIR ENHANCEMENT SYSTEM AND METHODS FOR FOOD PROCESSING SYSTEMS

A. 35 U.S.C. §119(e)

This application claims the benefit of U.S. Provisional Application No. APPLICATION NO. FILING DATE 60/527,910 Dec. 8, 2003.

TECHNICAL FIELD

Certain embodiments of the present invention relate to freezer and oven stacks in a food processing system for freezing or heating food product. More particularly, certain embodiments of the present invention relate to enhancing airflow through a freezer or oven stack to improve the quality of the heated or frozen food product and to improve throughput and efficiency of the food processing system.

BACKGROUND OF THE INVENTION

Industrial food processing systems exist to both cook (i.e., heat) and freeze (i.e., cool) various types of food products before packaging and shipping the food products to distributors. In large-scale industrial applications, it is desirable to process (i.e., heat or cool) large quantities of food product in a short period of time while trying to maintain a high quality, uniformity, and yield of the food product.

FIG. 1 illustrates an example of a conventional food processing system 10 to cool or heat a food product. The conventional food processing system 10 includes a heat exchanger 20 having a coil 25, a circulation fan or blower 30, and a vertically oriented spiral stack 40 having an internal conveyer belt to move the food product vertically through the stack.

During operation, the fan 30 pulls air into the heat exchanger 20 and through the coil 25 which may be cooled or heated. As a result, the air passing over the coil 25 is cooled or heated and passes out of the heat exchanger 20 and into one end of the stack 40. The heated or cooled air passes through the multiple tiers of the conveyer belt within the stack 40 and out the other end of the stack 40 and towards the fan 30. As a result, the food product within the stack 40 is heated or cooled (e.g., cooked or frozen).

The circulation fan 30 is responsible to circulate the air within the system 10 through the heat exchanger 20 and the stack 40. However, as the air comes out of the fan 30 and passes through the heat exchanger 20, the air loses velocity. Also, as the air is pulled through the stack 40, it further loses velocity. The loss in velocity of air through the system 10 can contribute to reduced efficiencies in heating or cooling the food product within the stack 40 and result in poor quality control of the food product. For example, the air flowing through the stack 40 may become non-uniform creating hot spots and cool spots within the stack 40.

Other food processing systems and methods are described below in the following patents.

Further limitations and disadvantages of conventional, traditional, and proposed approaches will become apparent to one of skill in the art, through comparison of such systems with the present invention as set forth in the remainder of the present application with reference to the drawings.

BRIEF SUMMARY OF THE INVENTION

An embodiment of the present invention provides a system to enhance airflow through a vertically oriented spiral freezer or oven stack. The system comprises a vertically oriented spiral stack assembly and at least one high-static fan assembly mounted above the spiral stack assembly to accelerate and direct air vertically through the spiral stack assembly.

An embodiment of the present invention provides a method to enhance airflow through a vertically oriented spiral freezer or oven stack. The method comprises directing air through a heat exchanger via at least one circulation fan, cooling or heating the air via a heat exchanger, and vertically accelerating the cooled or heated air through a vertically oriented spiral stack assembly via at least one high-static fan assembly mounted above the spiral stack assembly.

An embodiment of the present invention provides a method to retrofit a system having a vertically oriented spiral freezer or oven stack to enhance airflow through the stack. The method comprises mounting at least one high-static fan assembly above a vertically oriented spiral stack assembly to force air downward through the stack assembly, mounting at least one control panel in proximity to the system, electrically connecting the at least one control panel to the at least one high-static fan assembly to operationally control the at least one high-static fan assembly, installing a baffle approximately mid-way up the spiral stack assembly to help pressurize an upper side of the spiral stack assembly, and lining the baffle with a gasket to reduce an amount of air by-passing the spiral stack assembly.

These and other advantages and novel features of the present invention, as well as details of an illustrated embodiment thereof, will be more fully understood from the following description and drawings.

DETAILED DESCRIPTION OF THE INVENTION

Figure 2:
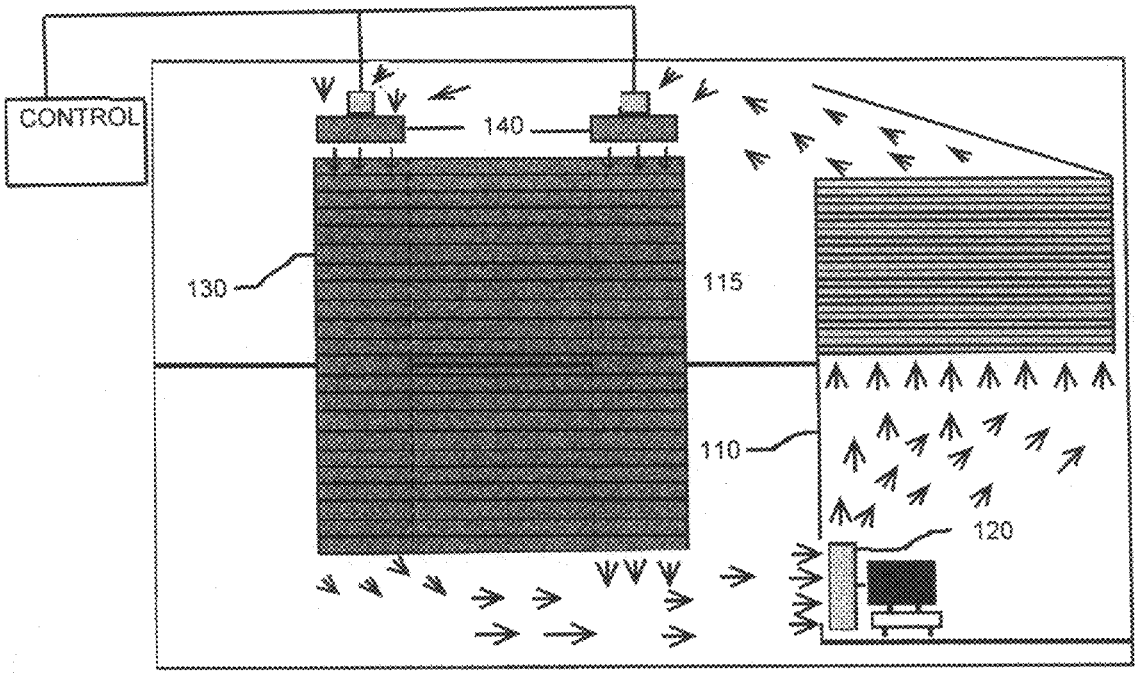
FIG. 2 illustrates an embodiment of a food processing system providing enhanced airflow, in accordance with various aspects of the present invention.

FIG. 2 illustrates an embodiment of a food processing system 100 providing enhanced airflow, in accordance with various aspects of the present invention. The food processing system 100 includes a heat exchanger 110 having a coil 115, at least one circulation fan or blower 120, and a vertically oriented spiral stack assembly 130 having an internal self-stacking conveyer belt to move the food product vertically through the stack 130. The system 100 also includes at least one high-static fan assembly 140 mounted above the stack 130. Further, the system 100 includes at least one control panel 150 electrically connected to the at least one high-static fan assembly 140 to control the fan assembly 140.

In accordance with an embodiment of the present invention, the circulation fan or blower 120 may be mounted to an input of the heat exchanger 110. Alternatively, the circulation fan or blower 120 may be mounted to infrastructure just outside an input of the heat exchanger 110. In accordance with an embodiment of the present invention, the at least one high-static fan assembly 140 may be mounted to the vertically oriented spiral stack assembly 130. Alternatively, the at least one high-static fan assembly 140 may be mounted to infrastructure above the stack assembly 130. The at least one control panel 150 may be mounted, for example, to a wall of the system 100.

During operation, the circulation fan 120 pulls air (as indicated by the arrows in FIG. 2) into the bottom of the heat exchanger 110 and through the coil 115 which may be cooled or heated by conventional means known in the art. As a result, the air passing through the coil 115 is cooled or heated and passes out of the top of the heat exchanger 110. As the air comes out of the circulation fan 120 and passes through the heat exchanger 110, the velocity of the flowing air tends to decrease significantly due to resistance through the heat exchanger 110. Also, as the air is pulled through the stack 130, it can further lose velocity. A loss in velocity of air through the system 100 would contribute to reduced efficiencies in heating or cooling the food product within the stack 130 and result in poor quality control of the food product. For example, the air flowing through the stack 130 could become non-uniform creating hot spots and cool spots within the stack 130.

However, the high-static fan assembly 140 boosts the velocity of the air as the air exits the heat exchanger 110 and approaches the input to the stack 130. As a result, the airflow through the stack 130 is accelerated through the stack 130 by the high-static fan assembly 140 resulting in a more uniform, higher velocity, and higher volume airflow moving vertically through the stack 130 from top to bottom. Such an increased airflow results in improved efficiencies in heating or cooling the food product within the stack 130 and results in improved quality control of the food product. By using a high-static fan assembly, the air velocity is not changed dramatically when product load is varied as, for example, when surges in product load occur.

The heated or cooled air passes through the multiple tiers of the conveyer belt within the stack 130 and out the bottom end of the stack 130 and towards the circulation fan 120 to complete the cycle of airflow. As a result, the food product within the stack 130 is heated or cooled (e.g., cooked or frozen).

Figure 3:
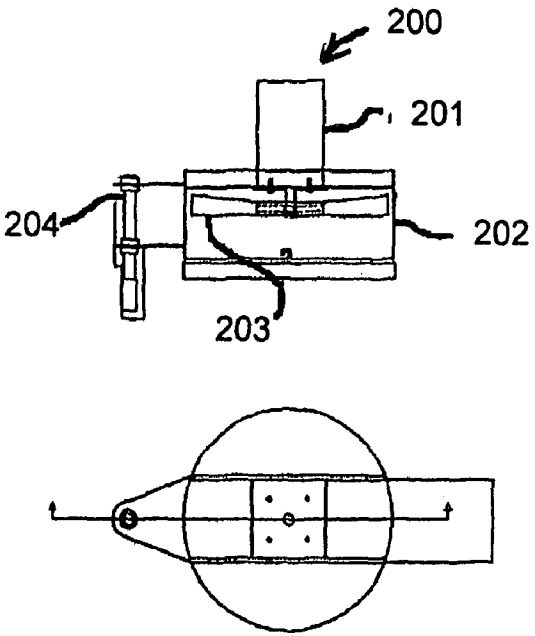
FIG. 3 illustrates an embodiment of a high-static fan assembly mounted above a vertically oriented spiral stack assembly in the system of FIG. 2, in accordance with various aspects of the present invention.
Figure 3:
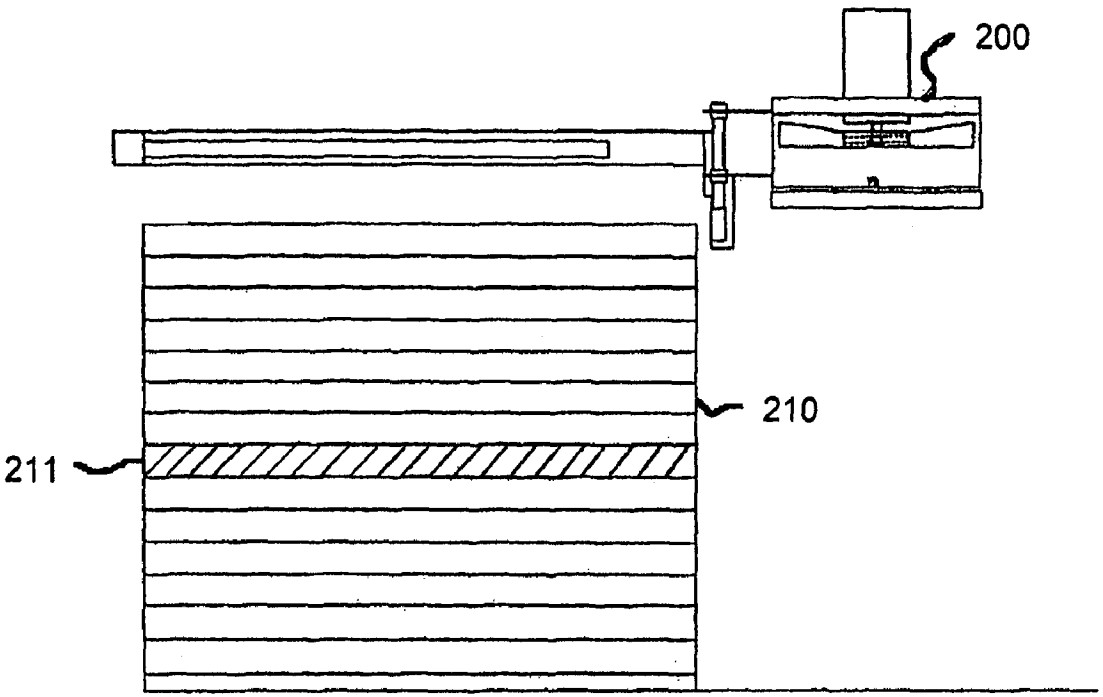

FIG. 3 illustrates an embodiment of a high-static fan assembly 200 mounted above a vertically oriented spiral stack assembly 210 in the system of FIG. 2, in accordance with various aspects of the present invention. The high-static fan assembly 200 comprises a motor 201, a blower housing and framing 202, a fan blade 203, and a support system 204. The blower housing and framing 202 contains the fan blade 203 and supports the motor 201. The fan blade 203 connects to a shaft of the motor 201. The support system 204 connects the blower housing and framing 202 to either the spiral stack assembly 210 or to an infrastructure located above the spiral stack assembly 210. In accordance with an embodiment of the present invention, the support system 204 allows the blower housing and framing 202 to pivot or rotate between an operational position directly over the stack assembly 210 and a cleaning position outside the circumference of the stack assembly 210. The spiral stack assembly 210 includes a baffle or deck 211 that is lines with a gasket.

Figure 4:
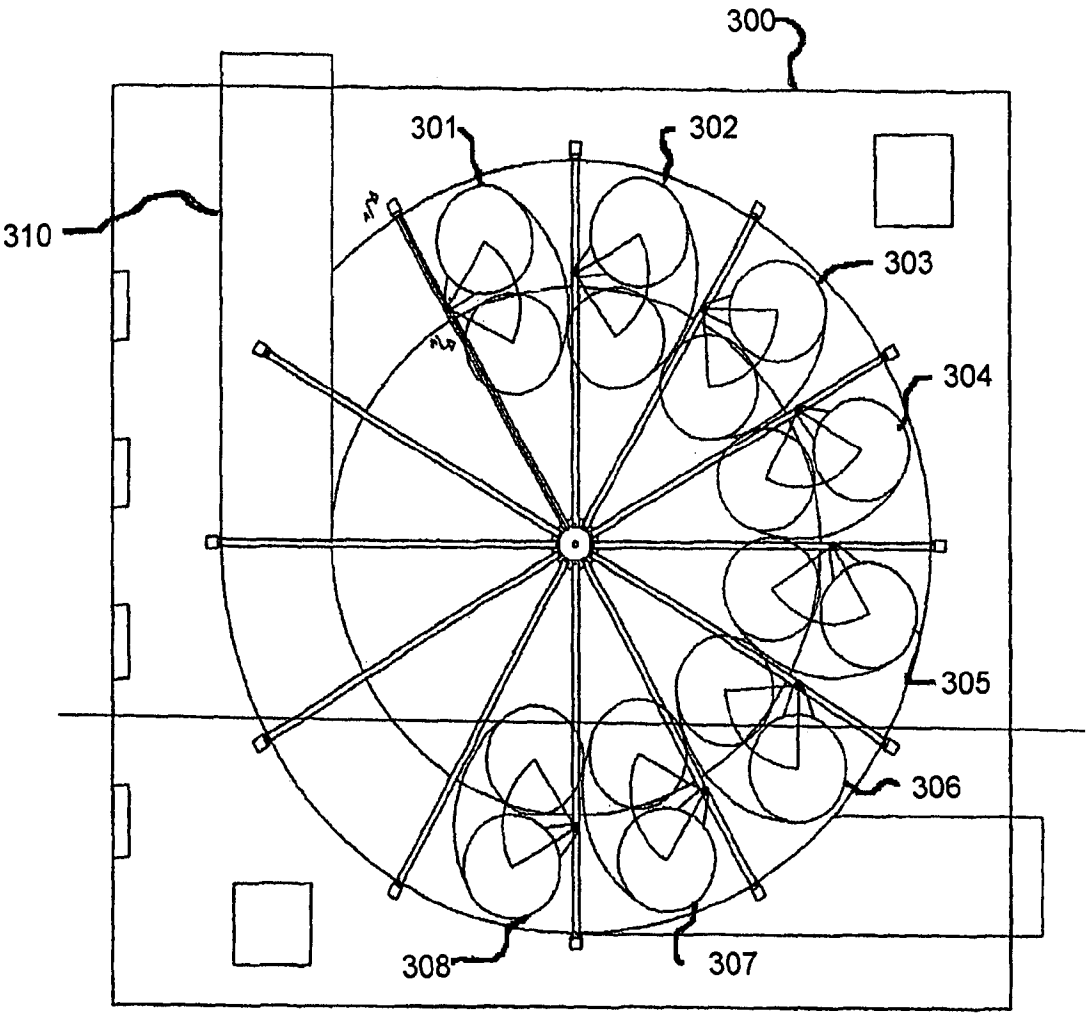
FIG. 4 illustrates a top view of a first embodiment of a plurality of high-static fan assemblies mounted above a vertically oriented spiral stack assembly, in accordance with various aspects of the present invention.

FIG. 4 illustrates a top view of a first embodiment of a plurality of high-static fan assemblies 301-308 mounted above a vertically oriented spiral stack assembly 300, in accordance with various aspects of the present invention. In such an embodiment, eight high-static fan assemblies 301-308 are positioned so as to cover most of the circumference of the stack assembly 300. The fan assemblies 301-308 may be rotated inward (i.e., toward the center of the stack assembly 300) for cleaning in this embodiment. FIG. 4 shows both the operational position and cleaning position for each fan assembly. The fan assemblies 301-308 are mounted to a multi-spoked infrastructure above the stack. A self-stacking conveyer belt 310 spirals around the vertically oriented stack assembly 300 to carry the food product. The fan assemblies 301-308 are positioned over the spiraling belt 310 during normal operation (i.e., in the operational position).

Figure 5:
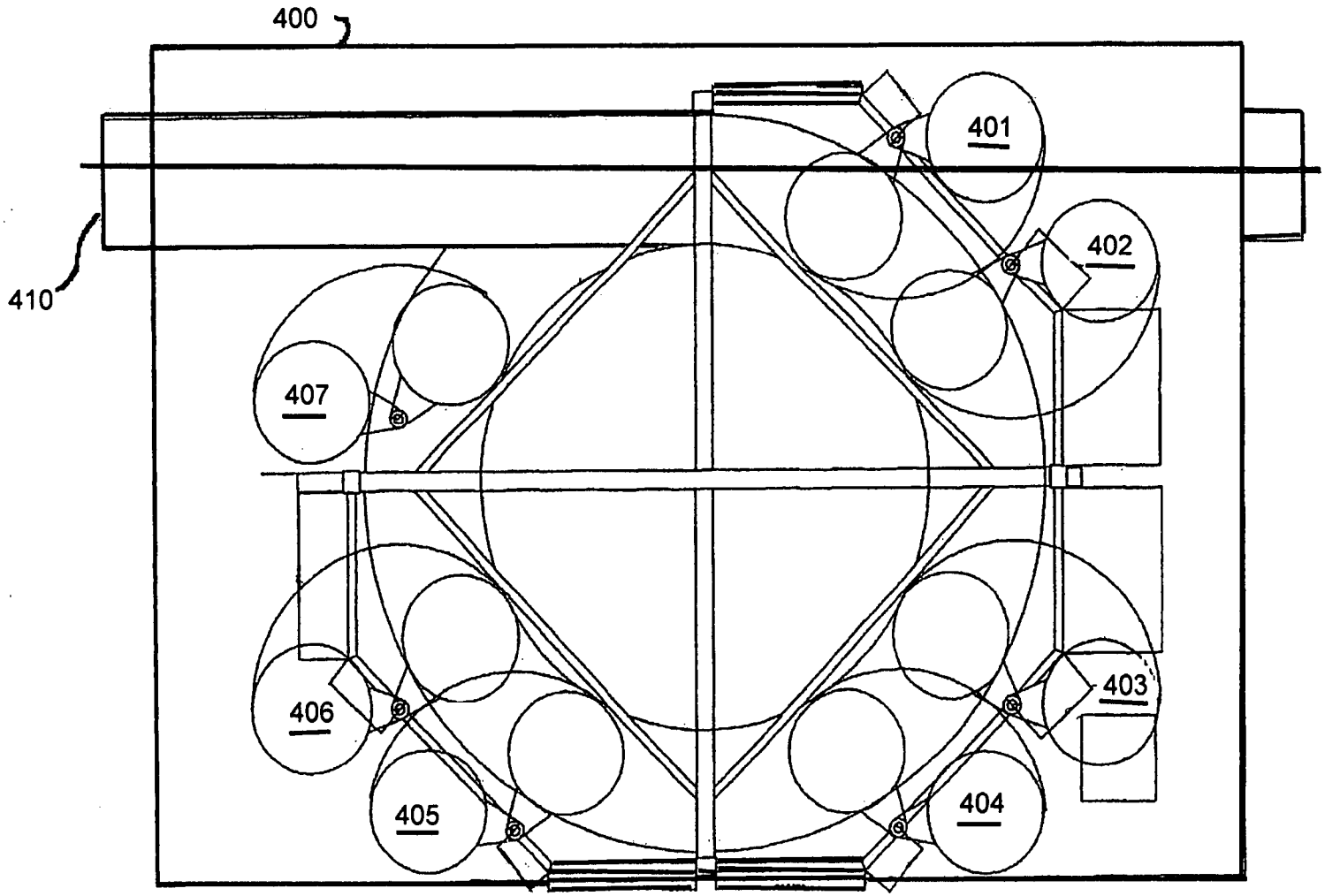
FIG. 5 illustrates a top view of a second embodiment of a plurality of high-static fan assemblies mounted above a vertically oriented spiral stack assembly, in accordance with various aspects of the present invention.

FIG. 5 illustrates a top view of a second embodiment of a plurality of high-static fan assemblies 401-407 mounted above a vertically oriented spiral stack assembly 400, in accordance with various aspects of the present invention. In such an embodiment, seven high-static fan assemblies 401-407 are positioned so as to cover most of the circumference of the stack assembly 400. The fan assemblies 401-407 may be rotated outward (i.e., outside the circumference of the stack assembly 400) for cleaning in this embodiment. FIG. 5 shows both the operational position and cleaning position for each fan assembly. The fan assemblies 401-407 are mounted to an infrastructure above and to the outside of the self-stacking belt 410 of the stack. The self-stacking conveyer belt 410 spirals around the vertically oriented stack assembly 400 to carry the food product. The fan assemblies 401-407 are positioned over the spiraling belt 410 during normal operation (i.e., in the operational position).

Figure 6:
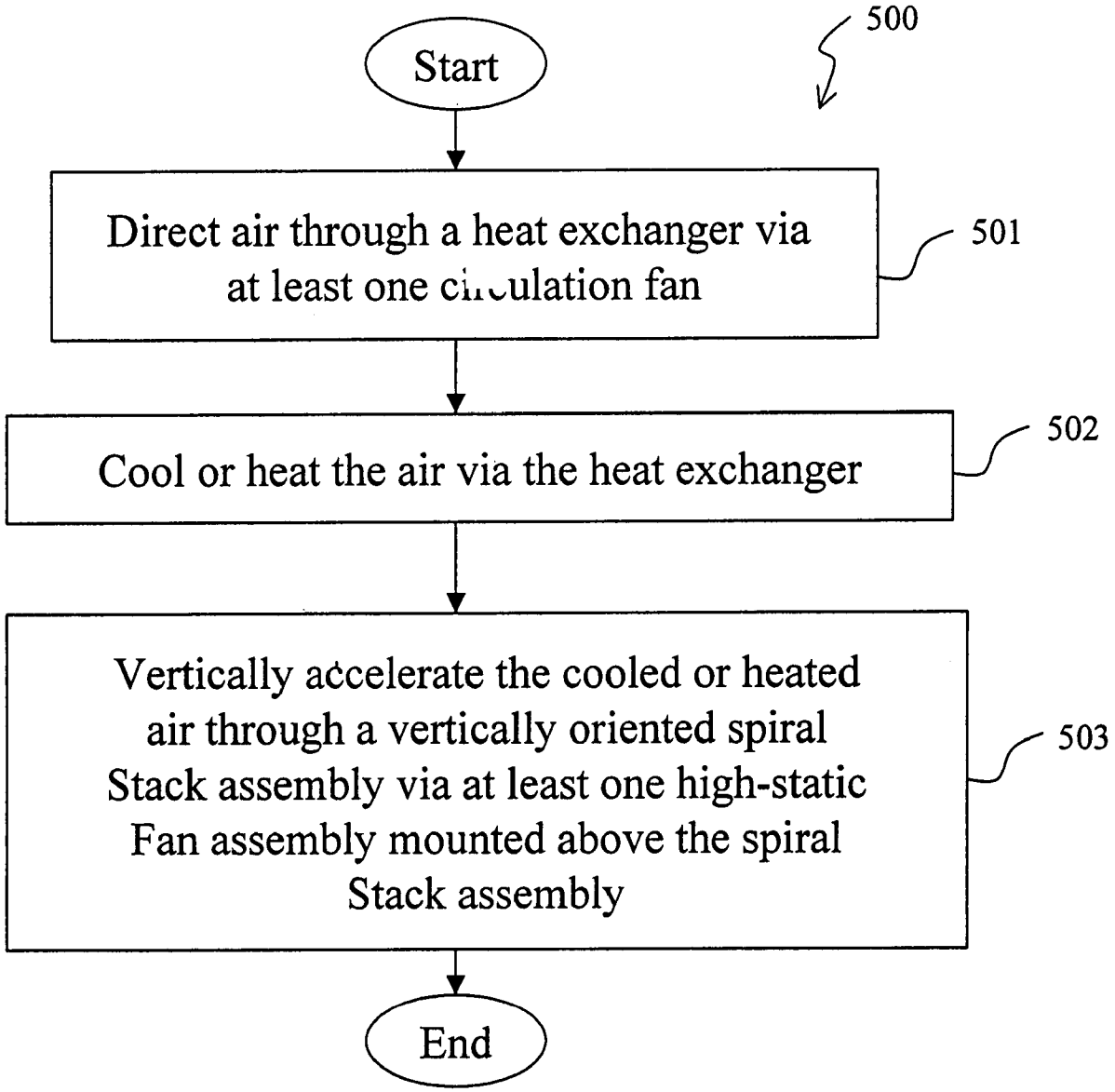
FIG. 6 is a flowchart of an embodiment of a method to enhance airflow through a vertically oriented spiral freezer or oven stack in the system of FIG. 2, in accordance with various aspects of the present invention.

FIG. 6 is a flowchart of an embodiment of a method 500 to enhance airflow through a vertically oriented spiral freezer or oven stack in the system of FIG. 2, in accordance with various aspects of the present invention. In step 501, air is directed through a heat exchanger via at least one circulation fan/blower. In step 502, the air is cooled or heated by the heat exchanger. In step 503, the cooled or heated air out of the heat exchanger is vertically accelerated through a vertically oriented spiral stack assembly by at least one high-static fan assembly mounted above the spiral stack assembly.

For example, referring to FIG. 2, the airflow moves from the circulation fan/blower 120 through the coil 115 within the heat exchanger 110. The velocity of the airflow is slowed by the resistance provided within the heat exchanger 110. The airflow leaving the top of the heat exchanger 110 is then captured by the high-static fan assembly 140 and accelerated through the spiral stack assembly 130 to provide a more uniform, higher velocity, and higher volume airflow moving vertically through the stack 130 from top to bottom, resulting in a more efficient process and yielding a higher quality food product.

Figure 1:
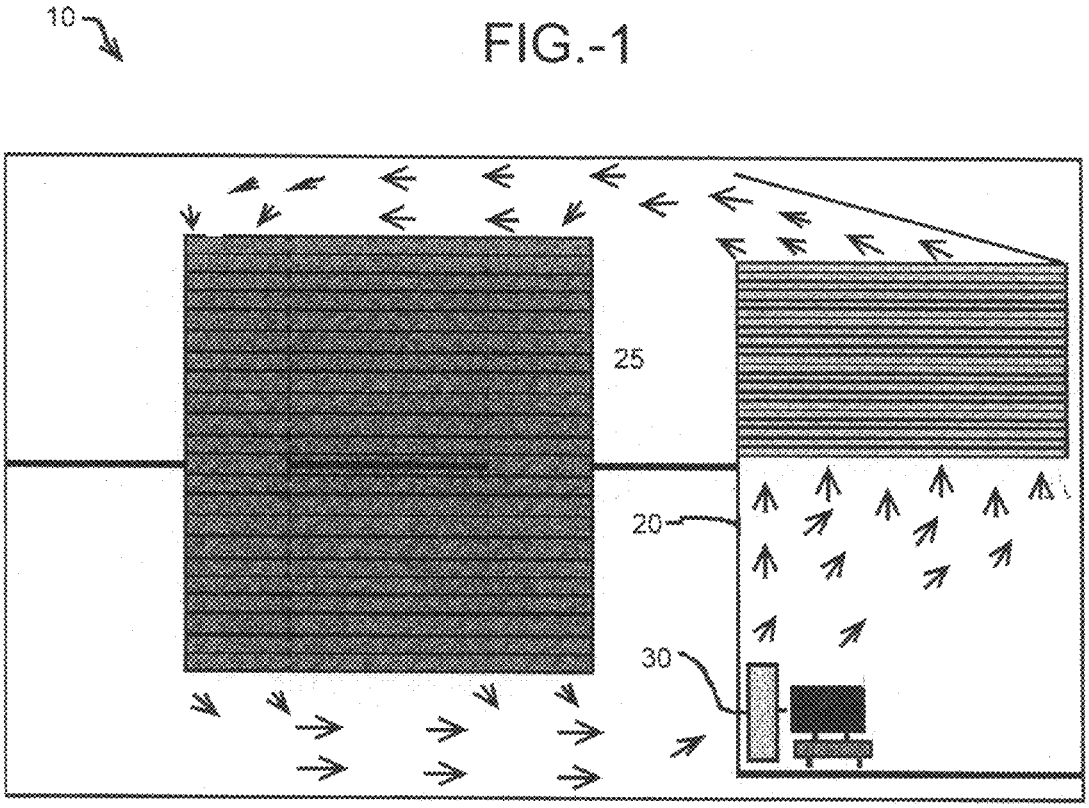
FIG. 1 illustrates an exemplary conventional food processing system to cool or heat a food product.
Figure 7:
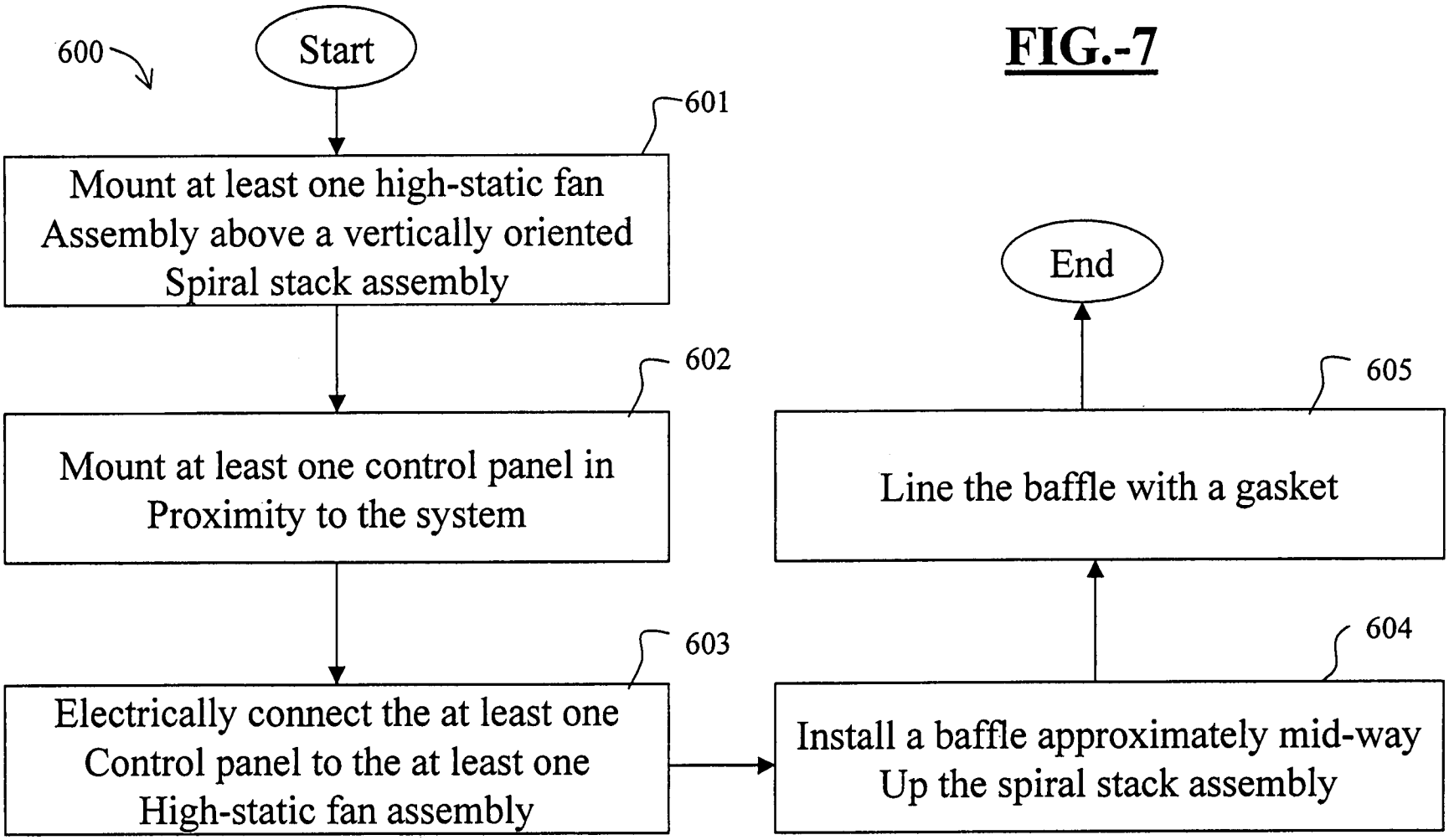
FIG. 7 is a flowchart of an embodiment of a method to retrofit the system of FIG. 1 to enhance airflow through a vertically oriented stack, in accordance with various aspects of the present invention.

FIG. 7 is a flowchart of an embodiment of a method 600 to retrofit the system of FIG. 1 to enhance airflow through a vertically oriented stack, in accordance with various aspects of the present invention. In step 601, at least one high-static fan assembly is mounted above a vertically oriented spiral stack assembly to force air downward through the stack assembly. In step 602, at least one control panel is mounted in proximity to the system. In step 603, the at least one control panel is electrically connected to the at least one high-static fan assembly to operationally control the at least one high-static fan assembly. In step 604, a baffle or deck is installed approximately mid-way up the spiral stack assembly to help pressurize an upper side of the spiral stack assembly. In step 605, the baffle is lined with a gasket to reduce an amount of air by-passing the spiral stack assembly.

Figure 8:
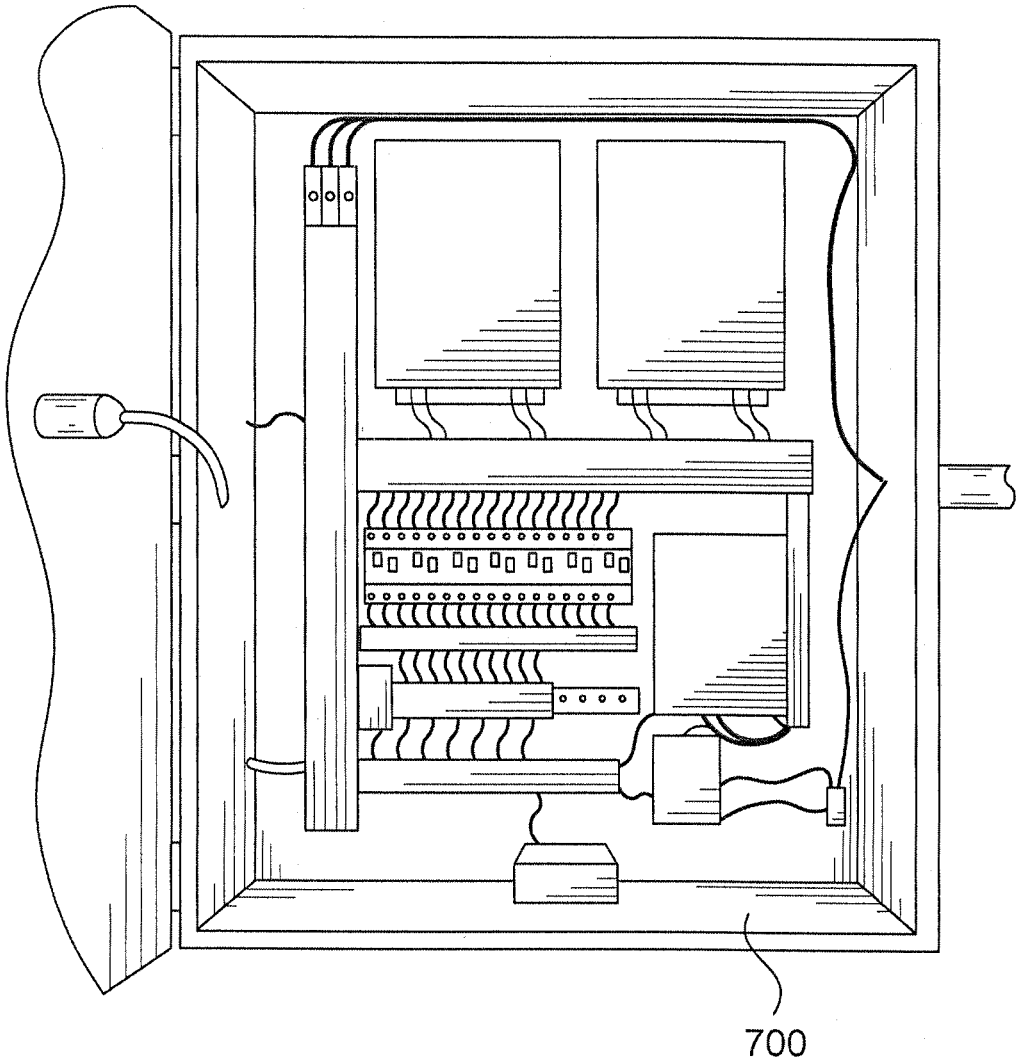
FIG. 8 illustrates an exemplary embodiment of a control panel of the system of FIG. 2, in accordance with various aspects of the present invention.

For example, referring to the system 100 of FIG. 2, a high-static fan assembly 140 is mounted above the vertically oriented spiral stack assembly 130. The high-static fan assembly 140 includes a pivoting support system 204 as shown in FIG. 3. A control panel 150 is mounted on, for example, a wall near the system 100 and is electrically connected to the high-static fan assembly 140 to control operation of the high-static fan assembly 140. In an embodiment of the present invention, the control panel 150 includes variable speed drives that are used to balance the air in the product zone within the vertically oriented spiral stack assembly 130. This keeps the velocity the same on the food product longer with less potential for creating dead spots throughout the freezing or heating process. FIG. 8 illustrates an exemplary embodiment of a control panel 700 of the system of FIG. 2, in accordance with various aspects of the present invention. As is shown in FIG. 3, a baffle or deck 211 is lined with a gasket and installed approximately mid-way up the stack 210 (or stack 130 in FIG. 2). The deck 211 allows the high-static fan assemblies to pressurize the upper side of the system, forcing the air through the stack 210 (130 in FIG. 2). The radius and perimeter of the deck 211 is lined with a gasket to reduce an amount of air by-passing the stack. The size and performance of the high-static fan assembly is typically matched to the size of the self-stacking conveyer belt. The retrofitted system may then be tested for proper operation such as, for example, making sure each high-static fan assembly produces a certain volume of air at so many cubic feet per minute (CFM) at a certain velocity of so many feet per minute (FPM) at the air input to the spiral stack assembly (i.e., the top of the spiral stack assembly).

A detailed embodiment of a food processing freezer system with enhanced airflow is described below. The food processing system includes a self-stacking belt averaging 1000 feet when installed and has 22 tiers of retention for food product. The system includes two 30-horse power circulation fans each having the capacity to produce 24,000 cubic feet per minute (CFM) of air or a total of 48,000 CFM at a velocity of 2900 feet per minute (FPM) at the inlet port to a heat exchanger. The air is directed through a coil mounted directly above the discharge of both fans within the heat exchanger. The air pressurizes the bottom side of the coil and is distributed through the coil for heat exchange to take place.

The coil has a 3-panel lid at the top or exit side of the heat exchanger and covers the entire exit area. The lid rises when the fans are energized, creating a backpressure to distribute the air across the coil face at a predetermined velocity. The air leaves the heat exchanger area being directed by the 3-panel lid towards the stack. The velocity of the air, due to an increase in area and resistance created by the stack, would drop to an average velocity of 290 FPM if not for the high-static fan assemblies mounted above the stack. This velocity establishes the rate at which heat is displaced from the food product on the belt. The rate of displacement of heat establishes a dwell time for each product, which varies from incoming and exiting temperatures relating to product specifications.

Seven high-static fan assemblies are mounted above the stack. Each high-static fan assembly is able to develop a volume of air of 10,500 CFM at a velocity of 3000 FPM. The blower housing and framing of each high-static fan assembly are 304 stainless steel with aluminum-extruded blades. A control panel, having variable speed drives, is able to power several high static fan assemblies. The support system for the blower housing and framing is also 304 stainless steel. The system is designed for each high-static fan assembly to pivot from the run position to the clean position for cleaning purposes via the support system. The seven high-static fan assemblies are placed over the stack and cover 305 degrees of the stack's circumference. The blower dimensions are 27.75 inches in diameter with an 11-inch housing assembly. These dimensions will change as a function of the width of the belt. Each high-static fan assembly includes 3-horse power, 3-phase 460 volt motors rated at 1725 revolutions per minute (RPM).

Seven high-static fan assemblies are mounted above the stack. Each high-static fan assembly is able to develop a volume of air of 10,500 CFM at a velocity of 3000 FPM. The blower housing and framing of each high-static fan assembly are 304 stainless steel with aluminum extruded blades. A control panel, having variable speed drives, is able to power several high-static fan assemblies. The support system for the blower housing and framing is also 304 stainless steel. The system is designed for each high-static fan assembly to pivot from the run position to the clean position for cleaning purposes via the support system. The seven high-static fan assemblies are placed over the stack and cover a predetermined portion of the stack's circumference, such as 305 degrees of the stack's circumference in this embodiment. The particular amount of coverage will depend on factors such as overall stack size, the type of products to be processed, the belt loading characteristics, the fan characteristics and other aspects of a particular system. In this embodiment, the blower dimensions are 27.75 inches in diameter with an 11 inch housing assembly. These dimensions may change as a function of the width of the belt. Each high-static fan assembly may be configured using 3 horse power, 3-phase 460 volt motors rated at 1725 revolutions per minute (RPM), but again other configurations are contemplated to provide the desired operational characteristics.

When energized, the air-enhanced system grabs air from the exit of the heat exchanger and boosts the air through the product zone within the stack. The increase in air volume is possible due to the decrease in static resistance within the product zone and the pressurization to the inlet port of the high-static fan assemblies. The high-static fan assemblies essentially feed each other to create a vortex of air that assists in maintaining the airflow. This is critical in extracting heat from the product. The system includes AC drives that allow a user to control and balance the air to varying products. The system is designed to improve the airflow through the stack, taking the air of a conventional system at 290 FPM to a level of 1500 FPM with the seven high-static fan assemblies. The increase of airflow substantially reduces freezing time, allowing a user to speed up the product conveyer belt. By increasing the belt speed, the separation between product pieces also increases and allows the system to maintain the desired airflow while adding more product to the process. The increase is a minimum of 15% more product when the speed of the product belt is increased by 20%.

Ideally, the high-static fan assembly design is to span as much of the belt width and circumference as possible while containing the air in the product area for maximum extraction potential. By using a high-static blade, the air velocity is not changed as dramatically by varying product load or surges which occur during most processes. The variable drives are used to balance the air within the product zone which improves the extraction process throughout the process.

Also, by increasing the volume of air throughout the process, the enhanced system will improve performance of the coil in the heat exchanger. With increased product separation on the belt and with higher velocities established through the coil, ice and snow crystals are blown out and do not built up on the coil as fast. This equates to longer run periods between defrosting of the coil.

The enhanced system may also increase the yield of certain products. For example, the faster a meat or poultry product is frozen, the smaller the ice crystals that are produced within the muscle of the product. The more crystals retained in a given piece of product, the more weight is retained. In the event that a product is being produced at a temperature that has it displacing moisture before entering the freezer, the addition of a higher velocity airflow at a cold temperature will stop the displacement of moisture more quickly. The product will also crust over faster trapping the moisture inside of the product.

In summary, a system and method are disclosed for enhancing airflow through a vertically oriented spiral freezer or oven stack used for freezing or heating food product. At least one high-static fan assembly is mounted above a spiral stack assembly of the system to accelerate and direct air vertically through the spiral stack assembly. Air is directed through a heat exchanger via at least one circulation fan, cooling or heating the air via the heat exchanger. The cooled or heated air is vertically accelerated through the vertically oriented spiral stack assembly via at least one high-static fan assembly mounted above the spiral stack assembly. A method is also disclosed to retrofit a system having a vertically oriented spiral freezer or oven stack to enhance airflow through the stack.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A system to enhance airflow through a vertically oriented spiral freezer or oven stack, said system comprising:

a vertically oriented spiral stack assembly, wherein the spiral stack assembly includes a conveyor belt to move food product through said spiral stack assembly;

at least one high-static fan assembly mounted above said spiral stack assembly to accelerate and direct air vertically through said spiral stack assembly; and at least one control system to operationally control said at least one high-static fan assembly, wherein said conveyor belt comprises:

a self-stacking conveyer belt; and said spiral stack assembly includes a baffle approximately mid-way up said spiral stack assembly to help pressurize an upper side of said system.

2. The system of claim 1, further comprising:

a heat exchanger to cool or heat air; and at least one circulation fan to direct air through said heat exchanger.

3. The system of claim 1, wherein said high-static fan assembly comprises:

a fan;

a blower housing and framing containing said fan;

a motor connected to said fan and mounted to said blower housing and framing; and a support system connecting said blower housing and framing, with said fan and motor, to said spiral stack assembly.

4. The system of claim 1, wherein said at least one control panel includes at least one variable speed drive to power said at least one high-static fan assembly.

5. The system of claim 3, wherein said blower housing and framing and said support system are comprised of stainless steel.

6. The system of claim 1, wherein said motor comprises a three horse-power, three-phase, 460 volt motor rated at least at 1725 revolutions per minute (RPM).

7. A system to enhance airflow through a vertically oriented spiral freezer or oven stack, said system comprising:

a vertically oriented spiral stack assembly, wherein the spiral stack assembly includes a conveyor belt to move food product through said spiral stack assembly;

at least one high-static fan assembly mounted above said spiral stack assembly to accelerate and direct air vertically through said spiral stack assembly; and at least one control system to operationally control said at least one high-static fan assembly, wherein said at least one high-static fan assembly develops a volume of air at approximately 10,500 cubic feet per minute (CFM) at a velocity of approximately 3,000 feet per minute (FPM) at an input to said spiral stack assembly.

8. A system to enhance airflow through a vertically oriented spiral freezer or oven stack, said system comprising:

a vertically oriented spiral stack assembly, wherein the spiral stack assembly includes a conveyor belt to move food product through said spiral stack assembly;

at least one high-static fan assembly mounted above said spiral stack assembly to accelerate and direct air vertically through said spiral stack assembly; and at least one control system to operationally control said at least one high-static fan assembly, wherein said at least one high-static fan assembly is configured to deliver air vertically through said spiral stack assembly around at least 305 degrees of a circumference of said spiral stack assembly.

9. A system to enhance airflow through a vertically oriented spiral freezer or oven stack, said system comprising:

a vertically oriented spiral stack assembly, wherein the spiral stack assembly includes a conveyor belt to move food product through said spiral stack assembly;

at least one high-static fan assembly mounted above said spiral stack assembly to accelerate and direct air vertically through said spiral stack assembly; and at least one control system to operationally control said at least one high-static fan assembly, wherein a support system allows a housing and framing of the fan assembly to be moved between an operational position and a non-operational position for cleaning.

10. A method to enhance airflow through a vertically oriented spiral freezer or oven stack, said method comprising:

transporting a food product through a vertically oriented spiral stack assembly to cool or heat the food product;

directing air through a heat exchanger via at least one circulation fan;

cooling or heating said air via said heat exchanger; and vertically accelerating said cooled or heated air through the vertically oriented spiral stack assembly via at least one high-static fan assembly mounted above said spiral stack assembly, further comprising moving said at least one high-static fan assembly between an operational position and a non-operational position for cleaning.

11. The method of claim 10, further comprising operationally controlling said at least one high-static fan assembly via at least one control panel.

12. The method of claim 10, wherein said food product is transported through said spiral stack assembly via a self stacking conveyer belt.

13. A method to enhance airflow through a vertically oriented spiral freezer or oven stack, said method comprising:

transporting a food product through a vertically oriented spiral stack assembly to cool or heat the food product;

directing air through a heat exchanger via at least one circulation fan;

cooling or heating said air via said heat exchanger; and vertically accelerating said cooled or heated air through the vertically oriented spiral stack assembly via at least one high-static fan assembly mounted above said spiral stack assembly, wherein said at least one high-static fan assembly is configured to deliver air vertically through said spiral stack assembly around at least 305 degrees of a circumference of said spiral stack assembly.

14. A method to enhance airflow through a vertically oriented spiral freezer or oven stack, said method comprising:

transporting a food product through a vertically oriented spiral stack assembly to cool or heat the food product;

directing air through a heat exchanger via at least one circulation fan;

cooling or heating said air via said heat exchanger; and vertically accelerating said cooled or heated air through the vertically oriented spiral stack assembly via at least one high-static fan assembly mounted above said spiral stack assembly, wherein said at least one high-static fan assembly develops a volume of air at approximately 10,500 cubic feet per minute (CFM) at a velocity of approximately 3,000 feet per minute (FPM) at an input to said spiral stack assembly.

15. A method to retrofit a system having a vertically oriented spiral freezer or oven stack to enhance airflow through said stack, said method comprising:

mounting at least one high-static fan assembly above a vertically oriented spiral stack assembly to force air downward through said stack assembly;

mounting at least one control panel in proximity to said system;

electrically connecting said at least one control panel to said at least one high-static fan assembly, to operationally control said at least one high-static fan assembly;

installing a baffle approximately mid-way up said spiral stack assembly to help pressurize an upper side of said spiral stack assembly; and lining said baffle with a gasket to reduce an amount of air by-passing said spiral stack assembly.

16. The method of claim 15, wherein said system being retrofitted includes a heat exchanger to cool or heat air, and at least one circulation fan to direct air through said heat exchanger.

17. The method of claim 15, wherein said high-static fan assembly includes a fan, a blower housing and framing containing said fan, a motor connected to said fan and mounted to said blower housing and framing, and a support system connecting said blower housing and framing, with said fan and motor, to said spiral stack assembly.

18. The method of claim 15, wherein said spiral stack assembly includes a self-stacking conveyer belt to carry food product through said spiral stack assembly.

19. The method of claim 15, further comprising testing said retrofitted system to ensure proper operation.

20. The method of claim 19, wherein at least part of said proper operation includes developing a volume of air at approximately 10,500 cubic feet per minute (CFM) at a velocity of approximately 3,000 feet per minute (FPM) at an input to said spiral stack assembly.

21. The method of claim 15, wherein said at least one control panel includes at least one variable speed drive to power said at least one high-static fan assembly.

22. The method of claim 17, wherein said blower housing and framing and said support system are comprised of stainless steel.

23. The method of claim 17, wherein said motor comprises a three horse-power, three-phase, 460 volt motor rated at 1725 revolutions per minute (RPM).

24. The method of claim 15, wherein said mounting at least one high-static fan assembly is performed such that air is delivered by said at least one high-static fan assembly vertically through said spiral stack assembly around at least 305 degrees of a circumference of said spiral stack assembly.

25. The method of claim 15, wherein said mounting at least one high-static fan assembly is performed such that said at least one high-static fan assembly may be moved between an operational position and a non-operational position for cleaning.

26. The method of claim 18, further comprising matching a size and performance of said at least one high-static fan assembly to a size of said self-stacking conveyer belt before mounting said at least one high-static fan assembly.

* * * * *